United States Patent [19]

Hall

[11] 4,076,122

[45] Feb. 28, 1978

[54] PACKAGE OF BAGS

[75] Inventor: Stanley Darwin Hall, Taylors, S.C.

[73] Assignee: W. R. Grace & Co., Duncan, S.C.

[21] Appl. No.: 735,709

[22] Filed: Oct. 26, 1976

[51] Int. Cl.[2] ..... B65D 73/00

[52] U.S. Cl. ..... 206/460; 206/554; 206/813

[58] Field of Search ..... 206/344, 460, 526, 554, 206/813, 820; 229/69

[56] References Cited

U.S. PATENT DOCUMENTS

| | | | |
|---|---|---|---|
| 3,276,576 | 10/1966 | Langas et al. | 206/344 |
| 3,472,366 | 10/1969 | Ackerman | 206/344 |
| 3,587,843 | 6/1971 | Wing | 206/460 |
| 3,987,901 | 10/1976 | Dullinger | 206/460 X |

*Primary Examiner*—Steven E. Lipman

*Attorney, Agent, or Firm*—John J. Toney; William D. Lee, Jr.; John B. Hardaway

[57] ABSTRACT

This invention is directed to a chain of imbricated bags connected together and supported by carriers secured to opposite sides of the bags.

10 Claims, 3 Drawing Figures

PACKAGE OF BAGS

FIELD OF INVENTION

This invention relates to packaging and more particularly to a new and improved arrangement of open end bags.

BACKGROUND OF INVENTION

Imbricated bag packages have been widely accepted for various packaging requirements such as the packaging of food products. In the past, a number of developments have been made to provide a package of a plurality of overlying bags arranged along a strip. One such bag arrangement is disclosed in U.S. Pat. No. 3,161,347 issued on Dec. 15, 1964 to G. H. Hannon wherein a plurality of open end bags are arranged along a member in an overlying arrangement with a portion of each bag being in contact with the supporting member. Each of the bags has its opening at the same end of the package with each preceding bag in a given direction along the strip overlying the opening of the following bag. While Hannon was an improvement over the prior art this invention represents a further improvement in properly orienting the imbricated bags with respect to removing the bags from a supply source to a processing or loading station.

Another package of imbricated bags is disclosed in U.S. Pat. No. 3,587,843 issued on June 28, 1971 to Ralph L. Wing. In the Wing patent the imbricated bags are connected to two strands of tape adhered on the same side of the bag.

U.S. Pat. Nos. 3,587,844 and 3,587,845 issued on June 28, 1971 wherein a plurality of open end bags was positioned one on top of the other in an overlapping relationship with each of the bags being releasably secured to the next succeeding bag by adhesive means. In U.S. Pat. No. 3,587,844, a pair of adhesive splotches are utilized as the adhesive means while in U.S. Pat. No. 3,587,845 a pair of swatches of two faced adhesive members are utilized as the adhesive means. The bag packages in these two patents are not easily transported in a bag loading machine or printing device or processing station since no carriers are available for moving the bags.

There is further disclosed in U.S. Pat. No. 3,915,302 issued on Oct. 28, 1975 to Farrelly et al. a package of imbricated closed end bags wherein the bags are releasably attached to adhesive strips, as well as, adhesive materials on the inside and outside of the bags.

While the prior art shows a variety of packages of imbricated bags, it is a primary object of this invention to provide an improved package of imbricated bags. It is another object of the present invention to show an improved way to assemble a chain of overlying bags. It is still another object to provide a chain of imbricated open-end bags with improved orientation during use. Further, it is an object to provide a chain of imbricated bags where the bags may be fed with improved orientation to a conventional bag loading machine or processing station without having to incorporate any modification to the machines.

The foregoing and other objects are achieved by a chain of imbricated bags and method described below.

SUMMARY OF THE INVENTION

In one aspect, the present invention is a package or chain of imbricated bags with a first support or carrier removably secured to the bags on one side of the chain and a second support or carrier removably secured to the bags on the opposite side of the chain.

In another aspect, the present invention is a method of assembling a chain of imbricated bags for improved orientation by securing a removable first carrier to the bags on one side of the chain and securing a removable second carrier to the bags on the opposite side of the chain.

In still another aspect, the present invention is a chain of imbricated bags, as described heretofore, wound upon itself to form a roll of overlapping bags.

In still a further aspect, the present invention is a method of delivering a chain of imbricated bags with improved orientation to a processing station.

The invention may be better understood by reference to the drawings described below and the following description of the preferred embodiment.

DESCRIPTION OF THE DRAWINGS

In the drawings which are appended hereto and made a part of this disclosure.

DEFINITIONS

As used herein, the terms listed below will be understood to have the meaning set forth beside each term:

"Bag" means a receptacle or container constructed from flexible, thermoplastic film having one open end or mouth. It may be made from tubular stock by cutting the tube into a finite length and sealing one end thermally or with a metal clip or as used herein the term bag includes a receptacle or container, generally referred to as a pouch, constructed from sheet stock (single or multiple sheets) which is commonly made by folding a single sheet and thermally sealing the two free side edges of the sheet together leaving one open end.

"Processing station" means a device or apparatus for utilizing the bag or pouch; e.g., filling or loading the bag or treating the bag in some manner such as printing or marking.

"Stock container" means a supply box or receptacle containing a chain of imbricated bags.

PREFERRED EMBODIMENT

Figure 1:
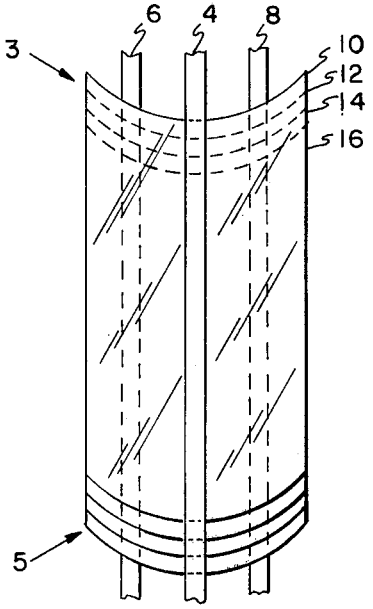
FIG. 1 is a front plan view of an illustrative chain of bags in accordance with the invention.

In FIG. 1, a chain of shingled or imbricated bags 10, 12, 14, 16 is shown in a front plan view. Also, reference is made to FIG. 2 which is a side plan view of chain 1 of FIG. 1. Only a small portion of the total chain of bags is in the drawings for purpose of illustration; the number of bags is arbitrary. The overlying bags are shown attached to one or more carriers or strands 6 and 8 on one side of the bags, the bags being connected to carrier 6 and 8 in a manner which is known in this art; e.g., as shown in U.S. Pat. No. 3,587,843.

A problem of handling imbricated or shingled bags exists at times when the bags are supported by only two parallel carriers, especially during placement and handling the chain of bags in and out of stock containers and in shipment and handling of filled containers; the sealed or loose ends of the bags become disoriented relative to each other, and become folded over or wrinkled. There are times when it is highly desirable to maintain an alignment of the shingled bags.

Figure 2:
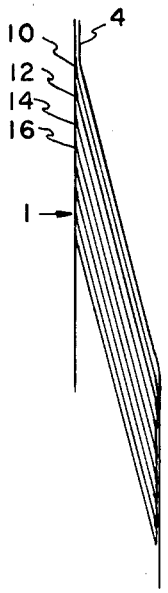
FIG. 2 is a diagrammatic side plan view of the chain of imbricated bags of FIG. 1.

It has now been found that securing or adhering a support or carrier 4 to the opposite side of the chain from one or more carriers or strands 6 and 8 will provide a control alignment of the bags one to another. Still referring to FIG. 1, the open end or mouth end 3 of each bag is oriented in the same direction in respect to the carriers as all of the other bags. As shown in FIGS. 1 and 2 each bag, after the bottom bag, overlies the open end of the underlying bag; leaving only the mouth of the forward most bag exposed. Also shown in both FIGS. 1 and 2 the open end portion 3 of each bag is secured to carriers 6 and 8 while the closed end or bottom portion 5 of each bag is secured to carrier 4 thus trapping the bags between carrier 4 and a pair of carriers 6 and 8 secured to the opposite side of the bags. Carrier 4, as shown, is preferably spaced transversely about midway between and longitudinally parallel to carrier 6 and 8. The carriers 4, 6 and 8 may be of the same or different types of adhesive material. Suitable materials are described in U.S. Pat. No. 3,587,843 incorporated herein by reference. The carriers 4, 6 and 8 may be secured to the bags in any suitable manner. At least one carrier is employed on each side. When a single carrier is used it is preferred a wider strip than when two strips of tape are used, e.g., a width of 2 inches to 9 inches.

The imbricated bags embodying this invention can be easily mounted and readily used while at the same time keeping the openings of the stack of bags below the top bag sanitarily covered. The disclosed chain of imbricated bags makes possible for the storing and utilizing of bags easily, efficiently, and with a minimum amount of difficulty.

Figure 3:
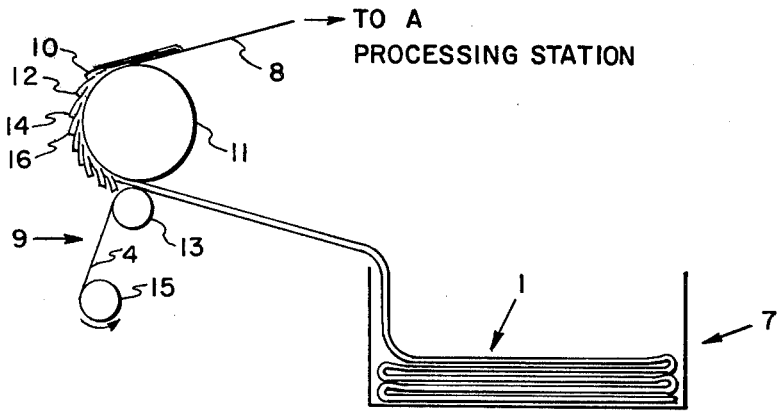
FIG. 3 is a diagrammatic illustration of feeding a chain of imbricated bags embodying the invention to a processing station.

It is frequently found that new equipment or apparatus is required for using a new package of bags; however, this is not the case with the chain of imbricated bags embodying this invention. Referring now to FIG. 3 wherein a method of delivering or feeding a chain of imbricated bags 1 from a supply source to a processing station is diagrammatically illustrated. One preferred method of storing such imbricated bags is to fold them as shown in stock container 7. The bags of this invention may also be stored in roll form as shown in FIG. 5 of U.S. Pat. No. 3,161,347.

The chain of bags is shown being fed from a supply or stock container 7 into guide means 9 for removing carrier or strand 4 to a guide or support means 11 then to a filling or processing station. Guide or support means 11 is illustrated for simplicity herein as a roller but can be a series of rollers or a table surface or any other support or guide means known in packaging apparatus art. FIG. 3 illustrates carrier 4 removal means 9 located in the path of the chain of imbricated bags just prior to guide 11. The carrier removal means is shown below the path of said chain; thusly, leaving the bags in tack with carriers 6 and 8 which are commonly used for pulling the bags forward. Removal means 9 as shown herein comprises an idle roller 13 and take up spool or reel 15. Any means can be used for removal of carrier or strand 4 but, again, for illustration purposes herein, idle rollers 13 and take up reel 15 are shown. Suitable devices for use of these bags are shown in U.S. Pat. Nos. 3,619,969 and 3,698,547. Further, it is to be understood that if the chain is fed in an upside down position from that shown, the carrier removal means would be above the delivery path of the bags.

I claim:

1. In a chain of bags wherein each bag has an open end and a closed end and sides extending between said open end and said closed end and wherein a plurality of bags are connected together in an imbricated arrangement by a first carrier removably secured to the bags on one side of each of the bags adjacent the open end thereof, the improvement comprising:

a second carrier removably secured to each of the bags on the other side of the bags adjacent the closed end thereof.

2. The improvement of claim 1 wherein the first carrier is an adhesive carrier.

3. The improvement of claim 1 wherein the second carrier is an adhesive carrier.

4. The improvement of claim 2 wherein the first carrier includes at least two parallel strands of tape.

5. The improvement of claim 3 wherein the second carrier is at least one strand of tape.

6. In a chain of imbricated bags wherein each bag has an open end and a closed end and sides extending between said open end and said closed end wherein said chain has a first carrier of at least two parallel strands of adhesive tape removably secured to one side of each of the bags adjacent the open end thereof the, improvement comprising:

a second carrier of at least one strand of adhesive tape removably secured to each of the bags on an opposite side from said first carrier adjacent the closed end thereof.

7. The improvement of claim 6 wherein said chain is wound about itself to form a roll of imbricated bags.

8. In a method of assemblying a chain of imbricated bags wherein each bag has an open end and a closed end and sides extending between said open end and said closed end and a first carrier is removably secured to one side of said chain of imbricated bags adjacent the open end of each of said bags, the improvement comprising:

securing a removable second carrier on the opposite side of said chain of imbricated bags adjacent the closed end thereof.

9. The improvement wherein said first and second carriers are strands of tape.

10. In a method of feeding a chain of imbricated bags to a processing station wherein each bag has an open end and a closed end and sides extending between said open end and said closed end and wherein at least two parallel spaced apart strands of adhesive tape are secured to each of said bags on one side of said chain adjacent the open end of each of said bags, said bags are pulled to a processing station by the use of at least one of said strands, and each of said strands of said tape are removed from each bag successively as it is employed at the processing station, the improvement comprising:

securing at least one strand of adhesive tape to each of said bags on the side of said bags opposite said two parallel spaced apart strands, and removing said strand from said opposite side prior to employing each of said bags at a processing station.

* * * * *

UNITED STATES PATENT OFFICE

CERTIFICATE OF CORRECTION

Patent No. 4,076,122 Dated February 28, 1978

Inventor(s) Stanley Darwin Hall

It is certified that error appears in the above-identified patent and that said Letters Patent are hereby corrected as shown below:

Claim 9, line 1, after "improvement" insert ---of claim 8---.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*